US009133856B2

(12) United States Patent
Wang

(10) Patent No.: US 9,133,856 B2
(45) Date of Patent: Sep. 15, 2015

(54) FAN BLADE ASSEMBLY

(71) Applicant: Frank Wang, Taichung (TW)

(72) Inventor: Frank Wang, Taichung (TW)

( * ) Notice: Subject to any disclaimer, the term of this patent is extended or adjusted under 35 U.S.C. 154(b) by 481 days.

(21) Appl. No.: 13/684,611

(22) Filed: Nov. 26, 2012

(65) Prior Publication Data

US 2013/0336797 A1 Dec. 19, 2013

(30) Foreign Application Priority Data

Jun. 18, 2012 (TW) ..... 101211698 U

(51) Int. Cl.
*F04D 29/34* (2006.01)
*F04D 29/32* (2006.01)

(52) U.S. Cl.
CPC ..... *F04D 29/34* (2013.01); *F04D 29/329* (2013.01)

(58) Field of Classification Search
None
See application file for complete search history.

(56) References Cited

U.S. PATENT DOCUMENTS

| | | | | |
|---|---|---|---|---|
| 7,121,805 | B2 * | 10/2006 | Chang et al. | 416/210 R |
| 7,481,626 | B2 * | 1/2009 | Gajewski | 416/220 A |
| 2010/0247316 | A1 * | 9/2010 | Aynsley et al. | 416/189 |
| 2011/0165002 | A1 * | 7/2011 | Noble | 417/423.7 |
| 2013/0003495 | A1 * | 1/2013 | Pyddoke | 366/343 |

* cited by examiner

*Primary Examiner* — Edward Look
*Assistant Examiner* — Justin Seabe
(74) *Attorney, Agent, or Firm* — Alan D. Kamrath; Kamrath IP Lawfirm, P.A.

(57) ABSTRACT

A fan blade assembly includes multiple blades sandwiched between a base and a cap. The base has a hollow shaft and has multiple mounting slots, positioning tubes and fixing holes. Each of the blades has a mounting seat having two lugs. The lugs of any two adjacent blades are inserted into the respective mounting slot. The mounting seat has at least one first through hole to allow insertion of the respective positioning tube, and has at least one second through hole. The cap has a mounting sleeve mounted on the shaft, multiple positioning posts each inserted into the respective first through hole and multiple threaded tubes each inserted into the respective second through hole. The fan blade assembly also includes multiple fastening screws each extended through the respective fixing hole and each screwed into the respective threaded tube.

5 Claims, 11 Drawing Sheets

FAN BLADE ASSEMBLY

BACKGROUND OF THE INVENTION

1. Field of the Invention

The present invention relates to a blade assembly and, more particularly, to a fan blade assembly.

2. Description of the Related Art

A conventional fan blade assembly comprises a base, a cap combined with the base, and a blade seat sandwiched between the base and the cap. The blade seat is formed integrally with a plurality of blades which are arranged in a radiating manner. The blade seat usually includes different sizes of about ten, twelve, fourteen and sixteen (10, 12, 14 and 16) inches. However, the blades are formed integrally on the blade seat so that the manufacturer has to make a mold with a larger volume to fabricate the blade seat with the blades, thereby increasing the cost of fabrication of the conventional fan blade assembly. In addition, the blades are formed integrally on the blade seat so that when one of the blades is worn out or broken during a long-term utilization, the user has to replace the whole blade seat, thereby increasing the cost of maintenance and replacement.

BRIEF SUMMARY OF THE INVENTION

In accordance with the present invention, there is provided a fan blade assembly, comprising a base, a cap combined with the base, and a plurality of blades sandwiched between the base and the cap. The base has a periphery provided with a first stepped edge. The base has a central portion provided with a hollow shaft to allow passage of a rotor of a motor. The base has a surface provided with a plurality of mounting slots for combining the blades, a plurality of positioning tubes for positioning the blades, and a plurality of fixing holes for locking the blades. Each of the mounting slots of the base has an arcuate shape. Each of the blades has an end provided with a mounting seat which has an arcuate shape. The mounting seat of each of the blades has a periphery provided with a second stepped edge abutting the first stepped edge of the base. The mounting seat of each of the blades has a side provided with two arcuate lugs each mounted in a respective one of the mounting slots of the base. Each of the lugs of each of the blades has a diameter which is half of that of each of the mounting slots of the base so that the lugs of any two adjacent blades are juxtaposed to each other and are inserted into the respective mounting slot of the base. The mounting seat of each of the blades has a surface provided with at least one first through hole to allow insertion of a respective one of the positioning tubes of the base, and provided with at least one second through hole aligning with a respective one of the fixing holes of the base. The first through hole of each of the blades has a depth greater than a length of each of the positioning tubes of the base. The cap has a central portion provided with a hollow mounting sleeve mounted on the shaft of the base. The mounting sleeve of the cap has an inner diameter equal to an outer diameter of the shaft of the base. The cap has a surface provided with a plurality of positioning posts and a plurality of threaded tubes. Each of the positioning posts of the cap is inserted into the respective first through hole of a respective one of the blades and is aligned with a respective one of the positioning tubes of the base. Each of the threaded tubes of the cap is inserted into the respective second through hole of a respective one of the blades and is aligned with a respective one of the fixing holes of the base, and the fan blade assembly further comprises a plurality of fastening screws each extended through a respective one of the fixing holes of the base and each screwed into a respective one of the threaded tubes of the cap so that the base, the blades and the cap are combined integrally.

Preferably, the shaft of the base has an outer wall provided with a plurality of reinforcing ribs.

Preferably, the cap is provided with a plurality of reinforcing ribs located at an outer wall of each of the positioning posts and each of the threaded tubes.

Preferably, each of the positioning posts of the cap abuts the respective positioning tube of the base and has a distal end provided with an elastic locking hook protruded outward from and locked onto the respective positioning tube of the base.

Alternatively, each of the positioning posts of the cap abuts the respective positioning tube of the base and has an interior provided with a screw bore, and the fan blade assembly further comprises a plurality of locking screws each extended through a respective one of the positioning tubes of the base and each screwed into the screw bore of a respective one of the positioning posts of the cap so that the base, the blades and the cap are combined integrally.

The primary objective of the present invention is to provide a fan blade assembly with replaceable blades.

According to the primary advantage of the present invention, each of the blades has the same structure so that the manufacturer only needs to make a single blade to fit the base and the cap, thereby reducing the whole volume of the mold, and thereby decreasing the cost of fabrication of the fan blade assembly.

According to another advantage of the present invention, the base and the cap co-operate to fit the blades of different sizes and specifications, thereby enhancing the versatility of the fan blade assembly.

According to a further advantage of the present invention, when one of the blades is worn out or broken during a long-term utilization, the user only needs to remove one of the blades without having to replace all of the blades, thereby decreasing the cost of maintenance and replacement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

Figure 3:
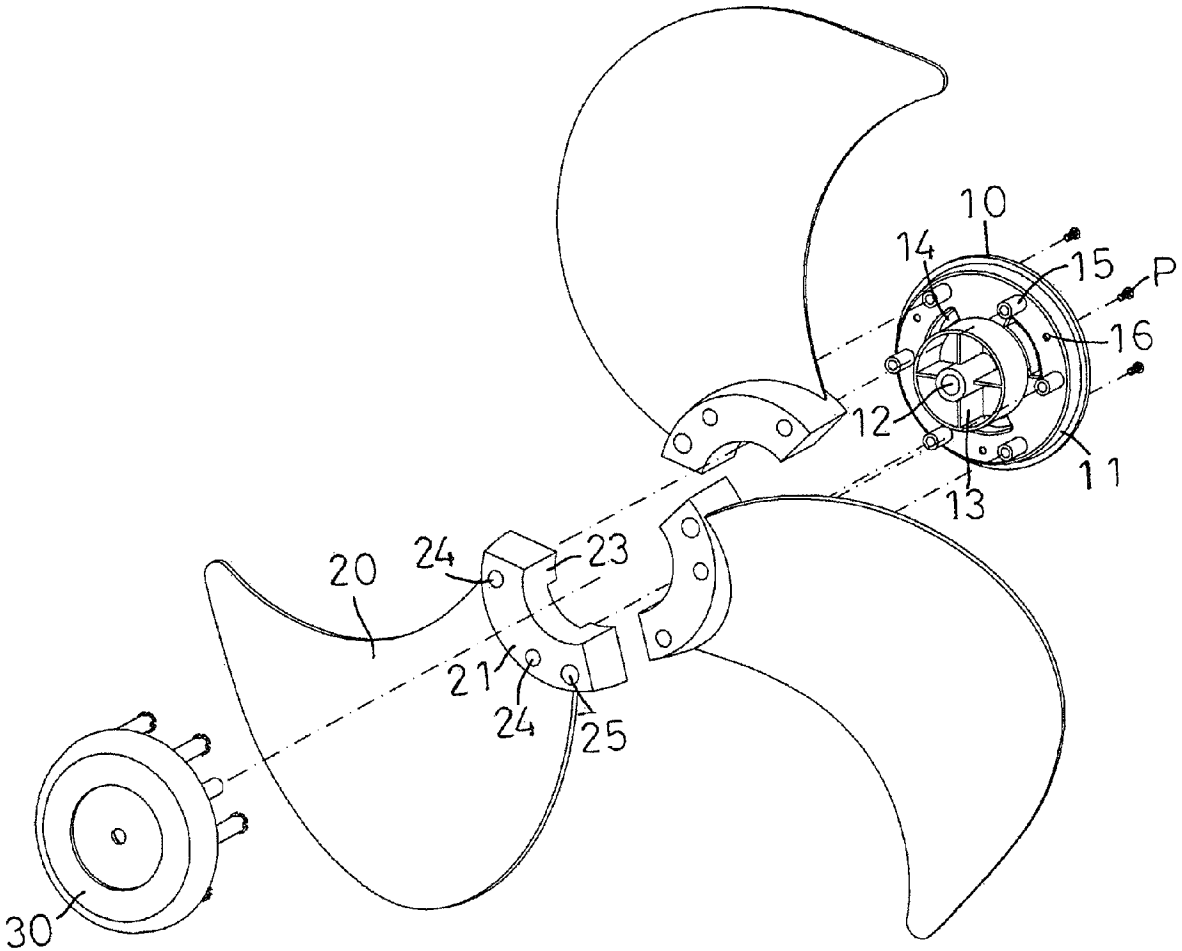
FIG. 3 is an exploded perspective view of the fan blade assembly as shown in FIG. 1.
Figure 3A:
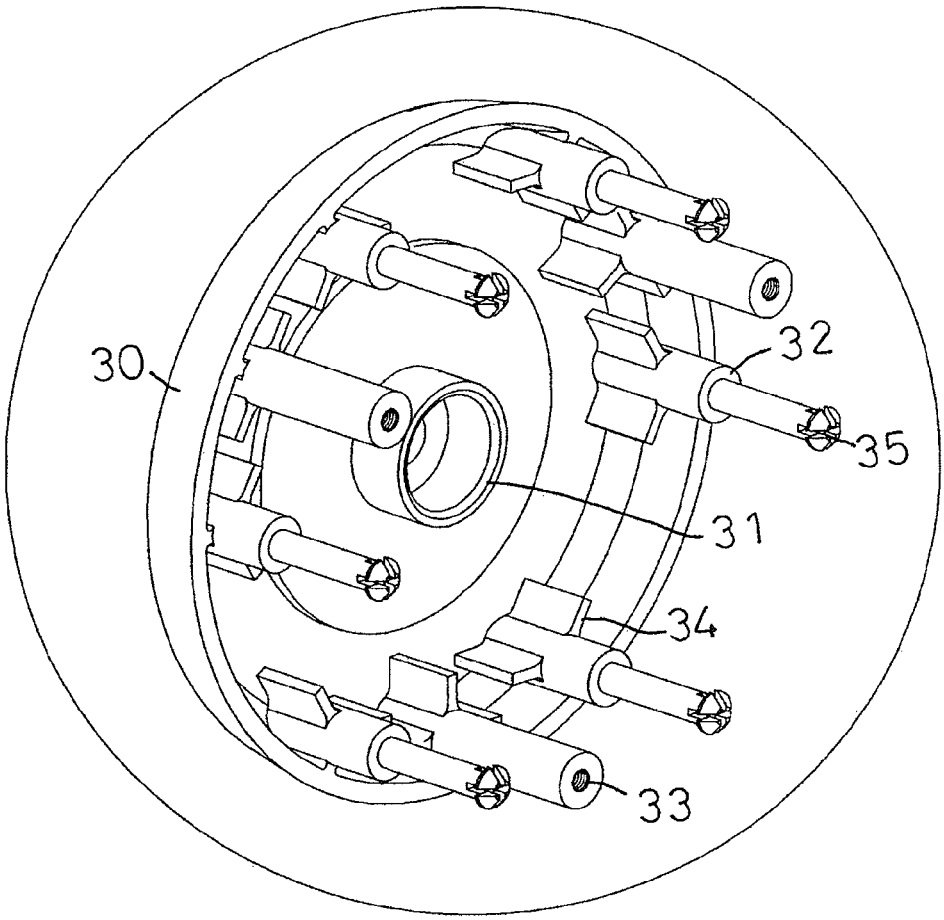

FIG. 3*a* is a perspective enlarged view of a cap of the fan blade assembly as shown in FIG. 3.

Figure 4:
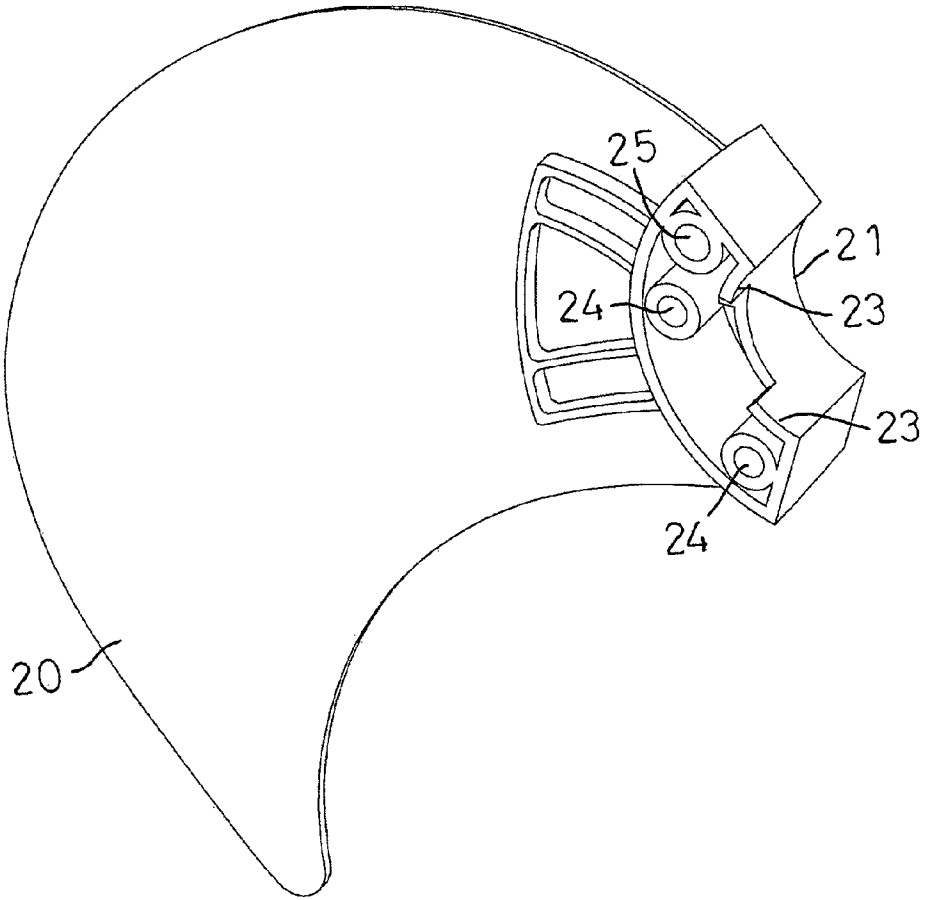

FIG. 4 is a rear perspective view of a blade of the fan blade assembly as shown in FIG. 3.

Figure 5:
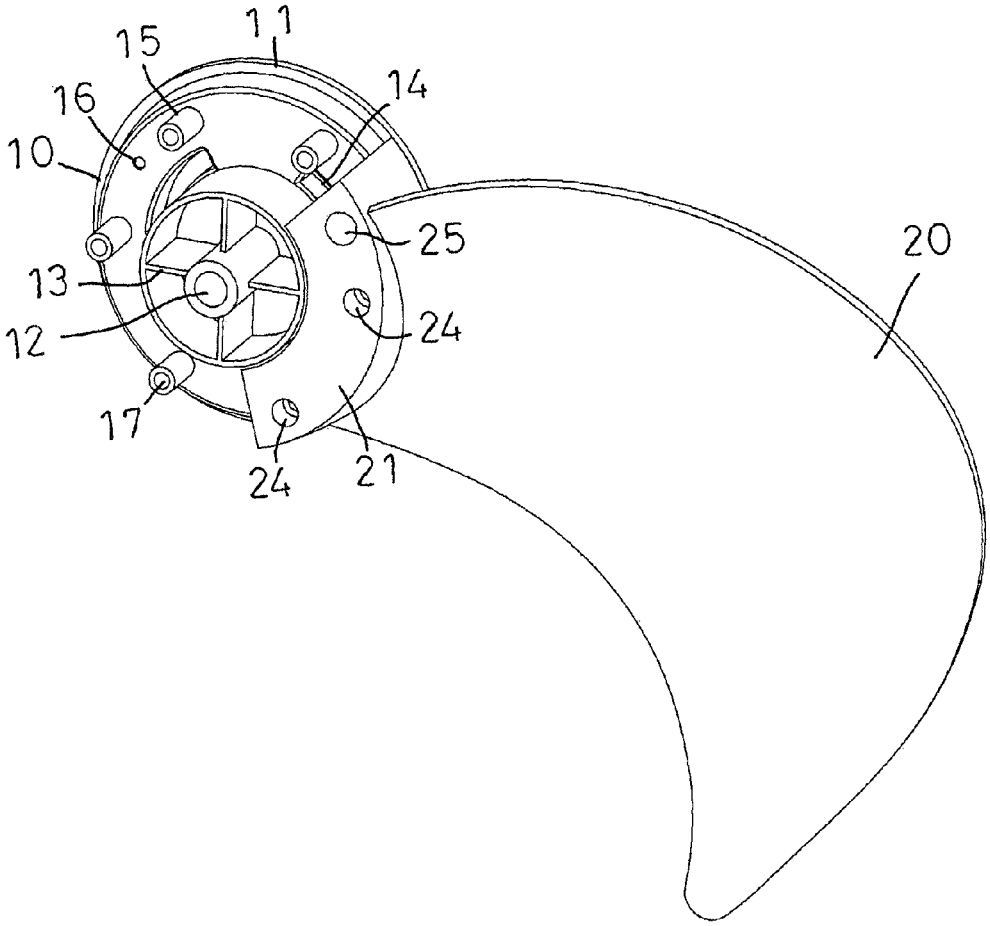

FIG. 5 is a partially perspective assembly view of the fan blade assembly as shown in FIG. 3.

Figure 1:
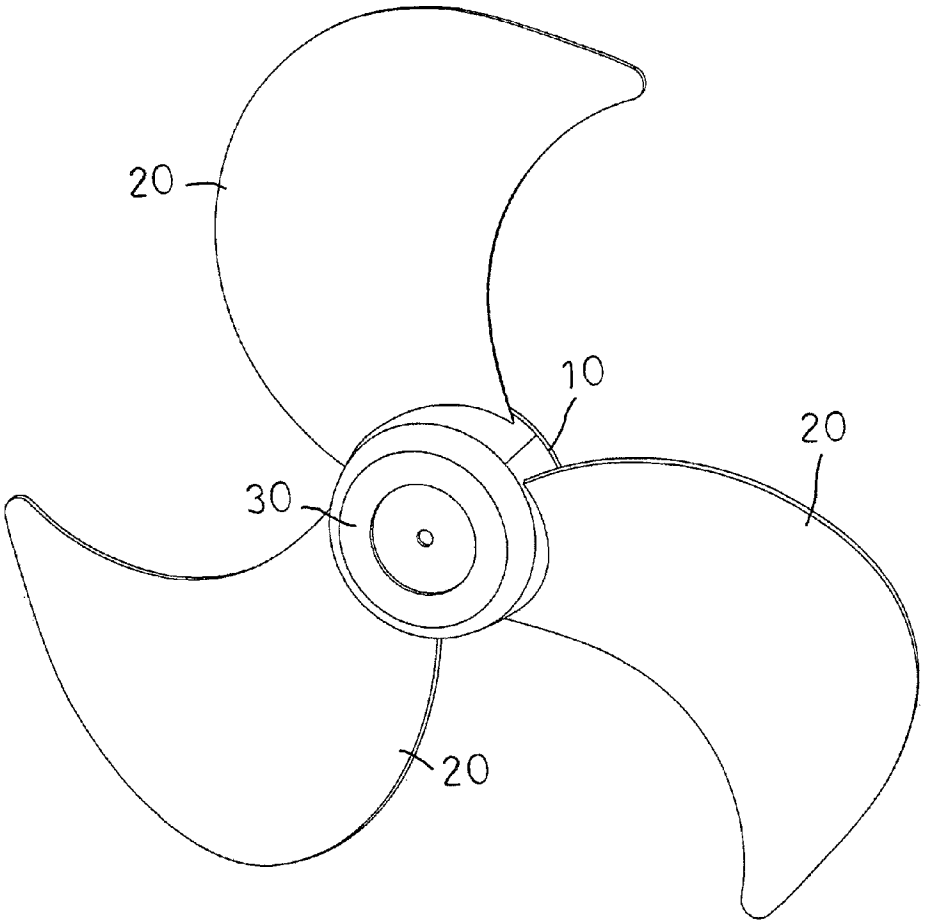
FIG. 1 is a front perspective view of a fan blade assembly in accordance with the preferred embodiment of the present invention.
Figure 2:
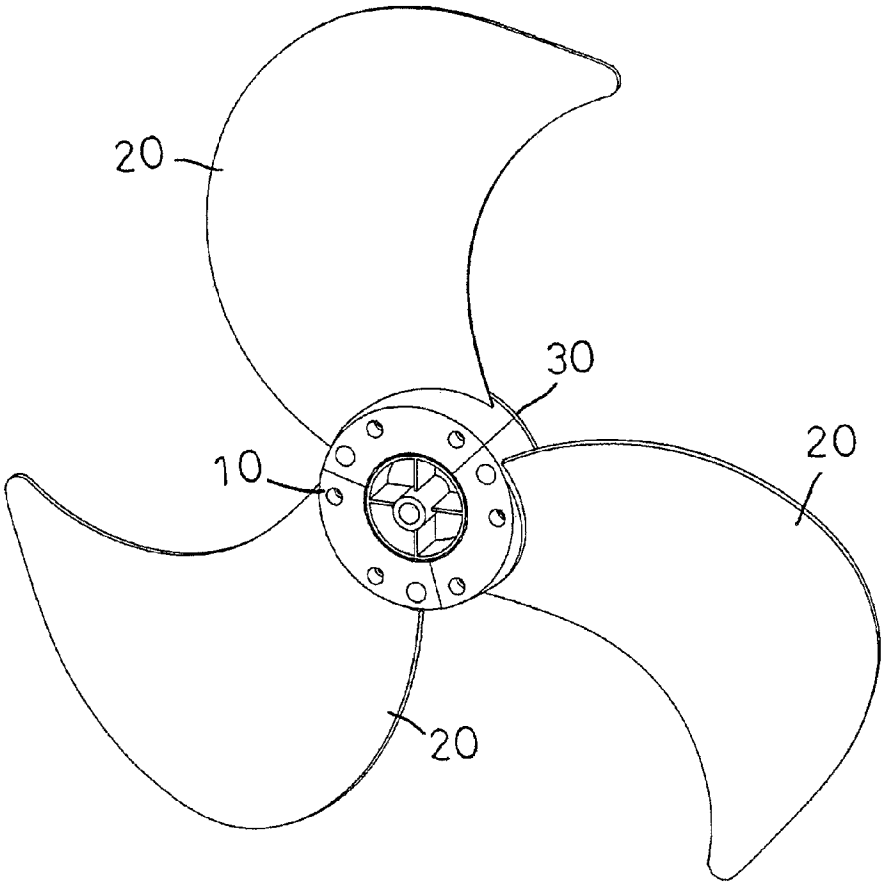
FIG. 2 is a rear perspective view of the fan blade assembly as shown in FIG. 1.
Figure 6:
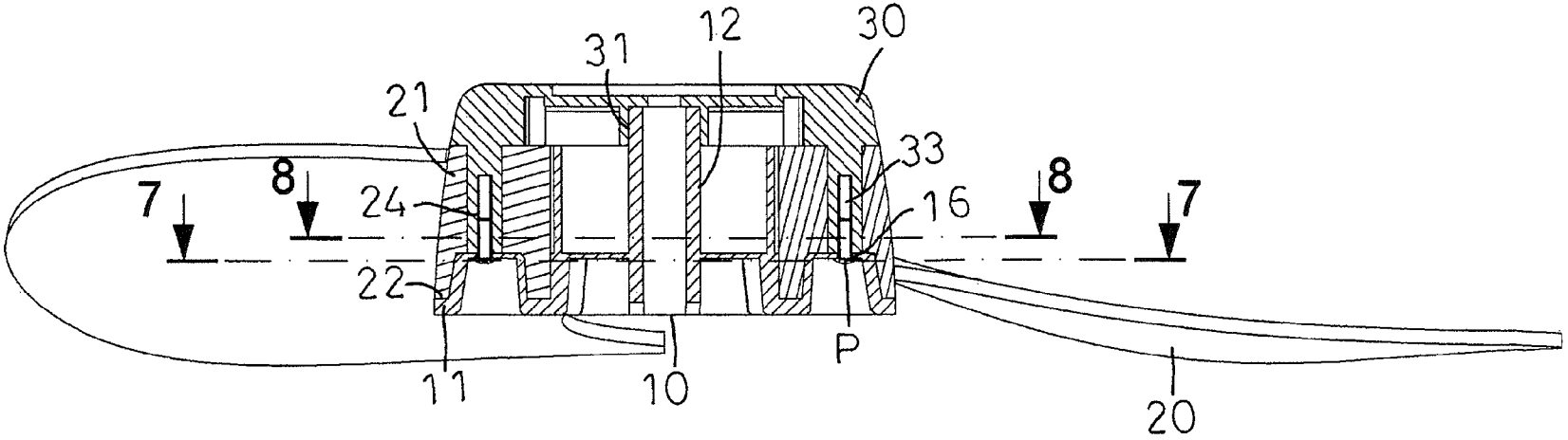

FIG. 6 is a top cross-sectional view of the fan blade assembly as shown in FIG. 1.

Figure 7:
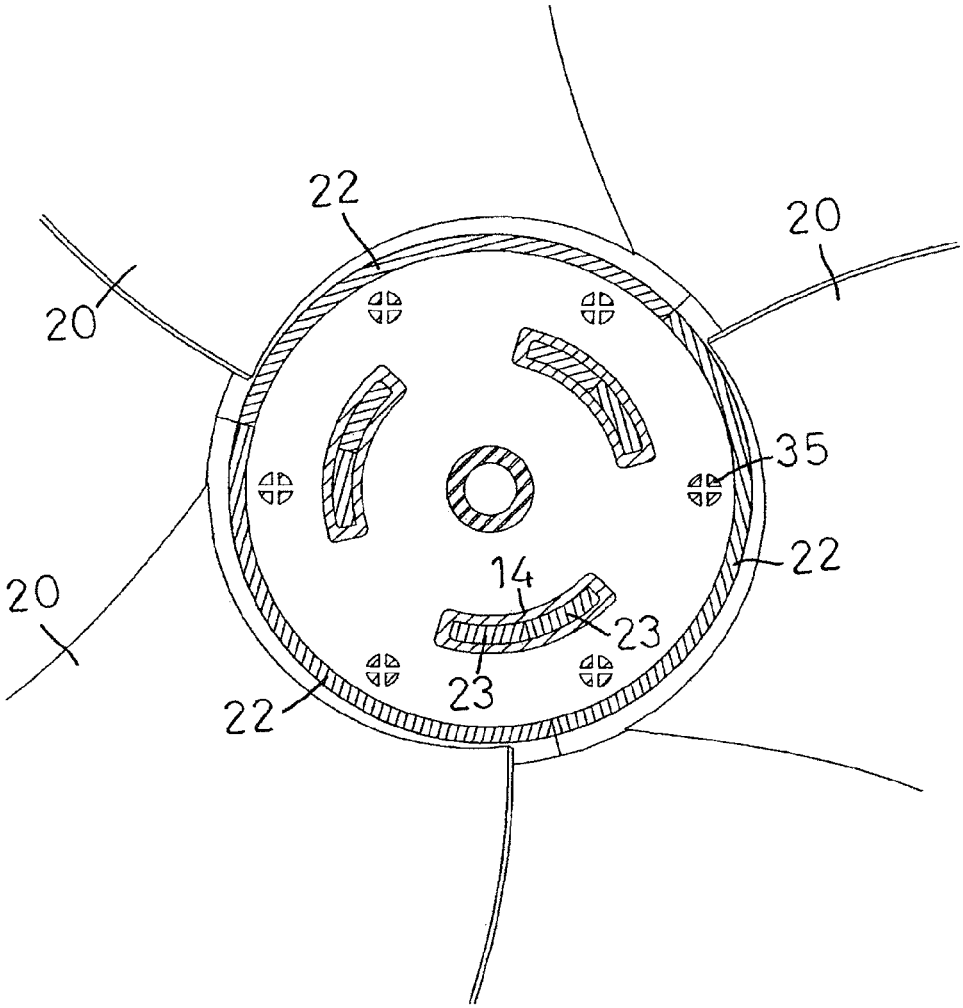

FIG. 7 is a cross-sectional view of the fan blade assembly taken along line 7-7 as shown in FIG. 6.

Figure 8:
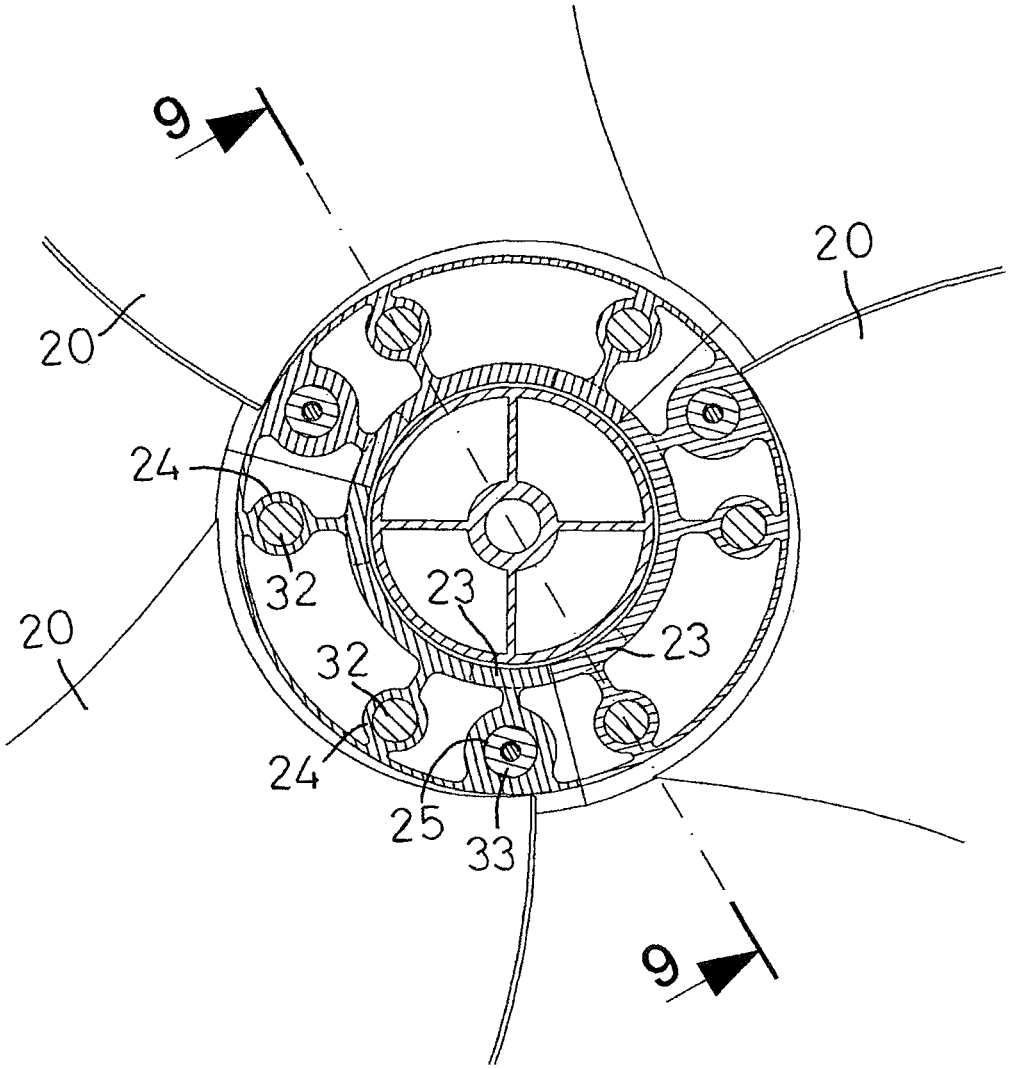

FIG. 8 is a cross-sectional view of the fan blade assembly taken along line 8-8 as shown in FIG. 6.

Figure 9:
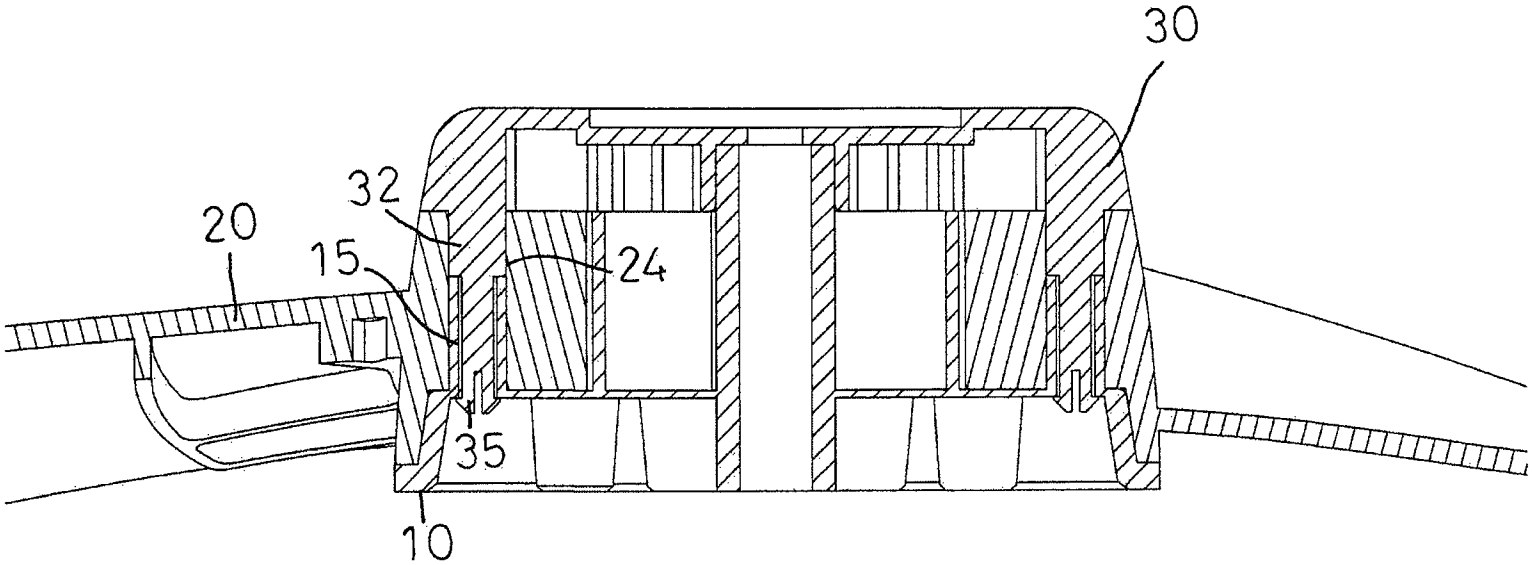

FIG. 9 is a cross-sectional view of the fan blade assembly taken along line 9-9 as shown in FIG. 8.

Figure 10:
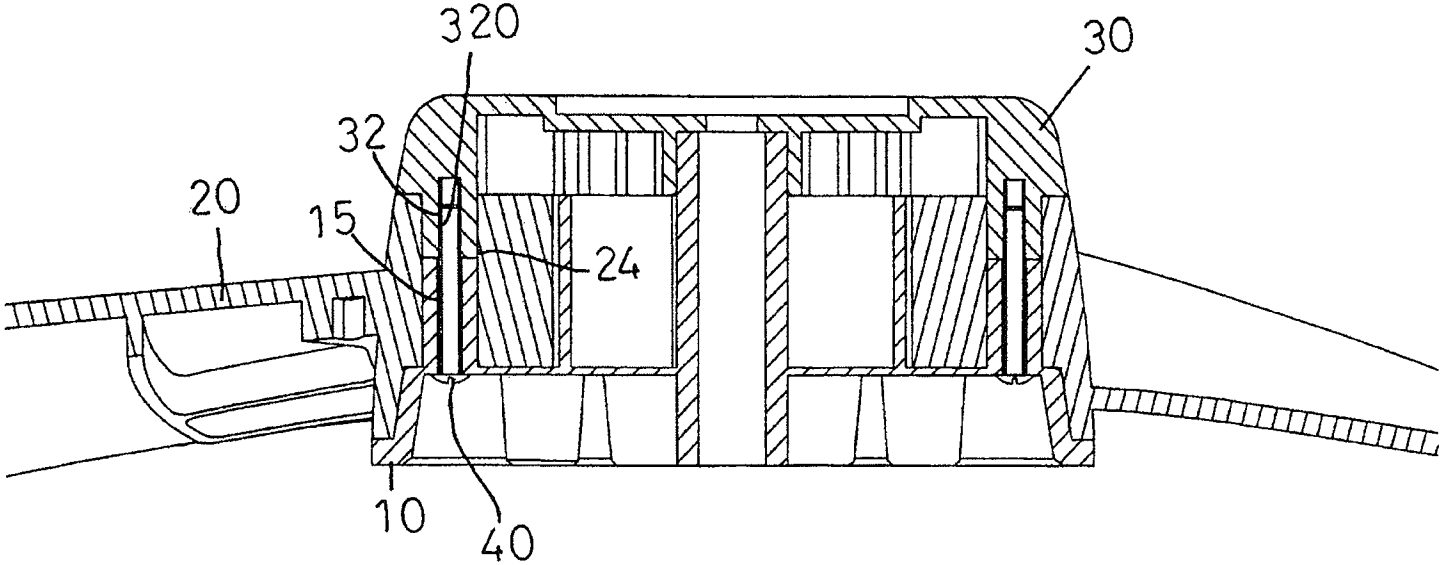

FIG. 10 is a top cross-sectional view of a fan blade assembly in accordance with another preferred embodiment of the present invention.

DETAILED DESCRIPTION OF THE INVENTION

Referring to the drawings and initially to FIGS. 1-9, a fan blade assembly in accordance with the preferred embodiment of the present invention comprises a base 10, a cap 30 combined with the base 10, and a plurality of blades 20 sandwiched between the base 10 and the cap 30.

The base 10 has a circular shape and has a periphery provided with a first stepped edge 11. The base 10 has a central portion provided with a hollow shaft 12 to allow passage of a rotor (not shown) of a motor (not shown). The base 10 has a surface provided with a plurality of mounting slots 14 for combining the blades 20, a plurality of positioning tubes 15 for positioning the blades 20, and a plurality of fixing holes 16 for locking the blades 20. The mounting slots 14 of the base 10 are spaced equally from each other. Each of the mounting slots 14 of the base 10 has an arcuate shape. The positioning tubes 15 of the base 10 are spaced equally from each other. The fixing holes 16 of the base 10 are spaced equally from each other. The shaft 12 of the base 10 has an outer wall provided with a plurality of reinforcing ribs 13.

Each of the blades 20 has an end provided with a mounting seat 21 which has an arcuate shape. The mounting seats 21 of the blades 20 are juxtaposed to each other to form a complete ring. The mounting seat 21 of each of the blades 20 has a periphery provided with a second stepped edge 22 abutting the first stepped edge 11 of the base 10. The second stepped edge 22 of each of the blades 20 has an arcuate shape. The mounting seat 21 of each of the blades 20 has a side provided with two arcuate lugs 23 each mounted in a respective one of the mounting slots 14 of the base 10. Each of the lugs 23 of each of the blades 20 has a diameter which is half of that of each of the mounting slots 14 of the base 10 so that the lugs 23 of any two adjacent blades 20 are juxtaposed to each other and are inserted into the respective mounting slot 14 of the base 10 as shown in FIG. 7. The mounting seat 21 of each of the blades 20 has a surface provided with at least one first through hole 24 to allow insertion of a respective one of the positioning tubes 15 of the base 10, and provided with at least one second through hole 25 aligning with a respective one of the fixing holes 16 of the base 10. The first through hole 24 of each of the blades 20 has a depth greater than a length of each of the positioning tubes 15 of the base 10.

The cap 30 has a circular shape and has a central portion provided with a hollow mounting sleeve 31 (see FIG. 3*a*) mounted on the shaft 12 of the base 10. The mounting sleeve 31 of the cap 30 has an inner diameter equal to an outer diameter of the shaft 12 of the base 10. The cap 30 has a surface provided with a plurality of positioning posts 32 and a plurality of threaded tubes 33. Each of the positioning posts 32 of the cap 30 is inserted into the respective first through hole 24 of a respective one of the blades 20 and is aligned with a respective one of the positioning tubes 15 of the base 10. Each of the positioning posts 32 of the cap 30 abuts the respective positioning tube 15 of the base 10 and has a distal end provided with an elastic locking hook 35 protruded outward from and locked onto the respective positioning tube 15 of the base 10 as shown in FIG. 9. Each of the threaded tubes 33 of the cap 30 is inserted into the respective second through hole 25 of a respective one of the blades 20 as shown in FIG. 8 and is aligned with a respective one of the fixing holes 16 of the base 10, and the fan blade assembly further comprises a plurality of fastening screws "P" each extended through a respective one of the fixing holes 16 of the base 10 and each screwed into a respective one of the threaded tubes 33 of the cap 30 as shown in FIG. 6 so that the base 10, the blades 20 and the cap 30 are combined integrally. The cap 30 is provided with a plurality of reinforcing ribs 34 located at an outer wall of each of the positioning posts 32 and each of the threaded tubes 33.

In the preferred embodiment of the present invention, the fan blade assembly comprises three blades 20, each of the blades 20 has two first through holes 24 and a second through hole 25, the base 10 has three mounting slots 14, six positioning tubes 15 and three fixing holes 16, and the cap 30 has six positioning posts 32 and three threaded tubes 33.

In assembly, when each of the blades 20 is combined with the base 10, the second stepped edge 22 of each of the blades 20 abuts the first stepped edge 11 of the base 10, each of the lugs 23 of each of the blades 20 is inserted into the respective mounting slot 14 of the base 10, and each of the positioning tubes 15 of the base 10 is inserted into the respective first through hole 24 of each of the blades 20. When the cap 30 is combined with the base 10 and each of the blades 20, the mounting sleeve 31 of the cap 30 is mounted on the shaft 12 of the base 10, each of the positioning posts 32 of the cap 30 is inserted into the respective first through hole 24 of the respective blade 20, and each of the threaded tubes 33 of the cap 30 is inserted into the respective second through hole 25 of the respective blade 20. Then, each of the fastening screws "P" is extended through the respective fixing hole 16 of the base 10 and screwed into the respective threaded tube 33 of the cap 30 so that the base 10, the blades 20 and the cap 30 are combined integrally.

Accordingly, each of the blades 20 has the same structure so that the manufacturer only needs to make a single blade 20 to fit the base 10 and the cap 30, thereby reducing the whole volume of the mold, and thereby decreasing the cost of fabrication of the fan blade assembly. In addition, the base 10 and the cap 30 co-operate to fit the blades 20 of different sizes and specifications, thereby enhancing the versatility of the fan blade assembly. Further, when one of the blades 20 is worn out or broken during a long-term utilization, the user only needs to remove one of the blades 20 without having to replace all of the blades 20, thereby decreasing the cost of maintenance and replacement.

Referring to FIG. 10, each of the positioning posts 32 of the cap 30 abuts the respective positioning tube 15 of the base 10 and has an interior provided with a screw bore 320, and the fan blade assembly further comprises a plurality of locking screws "40" each extended through a respective one of the positioning tubes 15 of the base 10 and each screwed into the screw bore 320 of a respective one of the positioning posts 32 of the cap 30 so that the base 10, the blades 20 and the cap 30 are combined integrally.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A fan blade assembly, comprising:

a base;

a cap combined with the base; and a plurality of blades sandwiched between the base and the cap; wherein:

the base has a periphery provided with a first stepped edge;

the base has a central portion provided with a hollow shaft to allow passage of a rotor of a motor;

the base has a surface provided with a plurality of mounting slots for combining the blades, a plurality of positioning tubes for positioning the blades, and a plurality of fixing holes for locking the blades;

each of the mounting slots of the base has an arcuate shape;

each of the blades has an end provided with a mounting seat which has an arcuate shape;

the mounting seat of each of the blades has a periphery provided with a second stepped edge abutting the first stepped edge of the base;

the mounting seat of each of the blades has a side provided with two arcuate lugs each mounted in a respective one of the mounting slots of the base;

each of the lugs of each of the blades has a diameter which is half of that of each of the mounting slots of the base;

the lugs of any two adjacent blades are juxtaposed to each other and are inserted into the respective mounting slot of the base;

the mounting seat of each of the blades has a surface provided with at least one first through hole to allow insertion of a respective one of the positioning tubes of the base, and provided with at least one second through hole aligning with a respective one of the fixing holes of the base;

the first through hole of each of the blades has a depth greater than a length of each of the positioning tubes of the base;

the cap has a central portion provided with a hollow mounting sleeve mounted on the shaft of the base;

the mounting sleeve of the cap has an inner diameter equal to an outer diameter of the shaft of the base;

the cap has a surface provided with a plurality of positioning posts and a plurality of threaded tubes;

each of the positioning posts of the cap is inserted into the respective first through hole of a respective one of the blades and is aligned with a respective one of the positioning tubes of the base;

each of the threaded tubes of the cap is inserted into the respective second through hole of a respective one of the blades and is aligned with a respective one of the fixing holes of the base; and the fan blade assembly further comprises a plurality of fastening screws each extended through a respective one of the fixing holes of the base and each screwed into a respective one of the threaded tubes of the cap so that the base, the blades and the cap are combined integrally.

2. The fan blade assembly of claim 1, wherein the shaft of the base has an outer wall provided with a plurality of reinforcing ribs.

3. The fan blade assembly of claim 1, wherein the cap is provided with a plurality of reinforcing ribs located at an outer wall of each of the positioning posts and each of the threaded tubes.

4. The fan blade assembly of claim 1, wherein each of the positioning posts of the cap abuts the respective positioning tube of the base and has a distal end provided with an elastic locking hook protruded outward from and locked onto the respective positioning tube of the base.

5. The fan blade assembly of claim 1, wherein each of the positioning posts of the cap abuts the respective positioning tube of the base and has an interior provided with a screw bore; and the fan blade assembly further comprises a plurality of locking screws each extended through a respective one of the positioning tubes of the base and each screwed into the screw bore of a respective one of the positioning posts of the cap so that the base, the blades and the cap are combined integrally.

* * * * *